United States Patent [19]

Nolan, Jr.

[11] 4,094,085

[45] June 13, 1978

[54] PICTURE FRAME APPARATUS

[76] Inventor: Ronald M. Nolan, Jr., 5739 Roanwood Way, Concord, Calif. 94521

[21] Appl. No.: 710,782

[22] Filed: Aug. 2, 1976

[51] Int. Cl.[2] ..... G09F 1/12

[52] U.S. Cl. ..... 40/152.1; 40/490

[58] Field of Search ..... 40/152, 154, 64, 16 R, 40/159, 10

[56] References Cited

U.S. PATENT DOCUMENTS

| | | | |
|---|---|---|---|
| 1,270,475 | 6/1918 | Wilkerson | 40/152 |
| 1,553,472 | 9/1925 | Pevorarchuk | 40/64 R |
| 2,296,596 | 9/1942 | Brown | 40/154 |
| 2,657,488 | 11/1953 | Knox | 40/152 |

FOREIGN PATENT DOCUMENTS

| | | | |
|---|---|---|---|
| 982,535 | 2/1954 | France | 40/159 |
| 1,070,964 | 2/1954 | France | 40/159 |

*Primary Examiner*—Louis G. Mancene
*Assistant Examiner*—Wenceslao J. Contreras
*Attorney, Agent, or Firm*—Phillips, Moore, Weissenberger, Lempio & Majestic

[57] ABSTRACT

A picture frame for displaying a plurality of baseball cards, photographs, or the like is disclosed. Included is a frame portion including top, bottom, and side struts and one or more vertical and horizontal struts, such that window openings are defined within the frame portion thereby. Elongated slots are defined for each window so that a card or the like can be seated therein. A hanger means is further provided, including a mounting plate with hooks attached thereto, such that the frame portion will mate therewith to removably affix the frame portion to a wall or other structure.

6 Claims, 6 Drawing Figures

PICTURE FRAME APPARATUS

BACKGROUND OF THE INVENTION

Prior art picture frames having a plurality of viewing areas or window openings are well known. However, applicant does not know of any prior art picture frames whereby pockets or slots are provided in which material can be placed in each window opening and wherein thereafter such material can be easily replaced when desired. Further, means for mounting the picture frame to a wall or other structure has in the past been performed usually by a metal hook on which the frame portion is hung.

SUMMARY OF THE INVENTION

The present invention is a picture frame apparatus for displaying a plurality of baseball cards, photographs, or the like, consisting of one piece of molded plastic formed in the shape of a frame portion including top, bottom, and side struts, and further including one or more of vertical and horizontal struts such that a plurality of window openings are defined within the frame portion thereby. A second piece of molded plastic is formed in the shape of a hanger means including a mounting plate with hooks formed thereon, to enable the frame portion and associated struts to be removably affixed to a wall or other structure. The hooks are sized such that a top edge flange, formed on the top strut of said frame portion, fits behind the hooks and thereby lies flush against the wall. The surface of each hook is further angled to support the rest of the frame portion, as will be more fully described hereinbelow.

Each card or the like is positioned about a given window opening by means of elongated slots formed in the struts via front and rear flanges extending therefrom. The rear flanges of each window opening are sized to facilitate easy insertion and removal of the cards or the like to be displayed.

Therefore, a primary object of the present invention is to produce an inexpensive yet sturdy picture frame apparatus for displaying a plurality of baseball cards or the like, preferably using molded plastic.

Another object of the present invention is to provide a means for hanging a frame portion in such a way that it is easily removable so that the cards or the like can be replaced, but wherein the picture frame when mated with the hooks is securely affixed to the wall or other structure.

A further object of the present invention is to provide means for removably attaching the cards or the like such that they are visible through the window openings defined in the picture frame, said means including elongated slots formed in the sides of each said window opening.

These and other objects of the present invention will become more readily apparent upon reference to the accompanying drawings and following description.

DESCRIPTION OF THE PREFERRED EMBODIMENT

Figure 1:
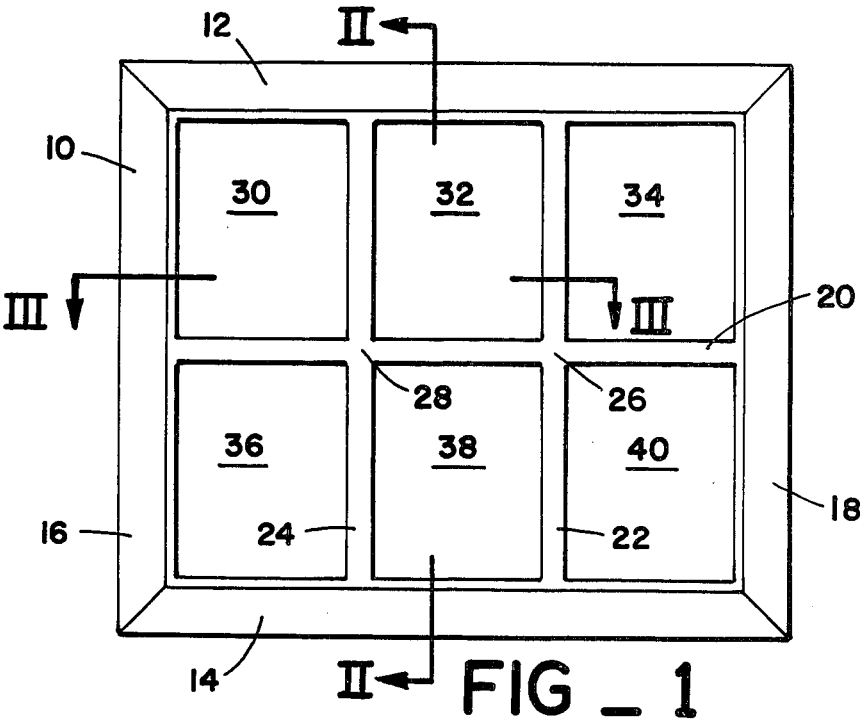
FIG. 1 illustrates the front view of a picture frame apparatus according to the present invention.

The front view of a picture frame apparatus according to the present invention is shown in FIG. 1. The picture frame apparatus includes a unitary piece of molded plastic having a thickness of 3/32 inch. The plastic used can be any inexpensive thermoplastic or thermosetting plastic available. The apparatus includes a frame portion 10 comprising a top edge strut 12, a bottom edge strut 14 and first and second side struts 16 and 18. The picture frame apparatus also includes strut means comprising at least one strut interconnecting two of said edge struts, 12, 14 and 16, 18, such that a plurality of window openings are defined within said frame portion thereby. FIG. 1 illustrates a frame apparatus having one horizontal strut 20 and two equally-spaced apart vertical struts 22 and 24. The preferred embodiment is to have the horizontal struts 20 oriented parallel to the top edge and bottom edge struts 12, 14, and the vertical strut 22, 24 oriented parallel to the first and second side struts 16, 18. Note that the vertical and horizontal struts join each other at cross points 26 and 28 formed therefrom.

The struts of FIG. 1 define six window openings, 30, 32, 34, 36, 38, and 40. Note that more or less vertical and horizontal struts can be provided to increase or decrease the plurality of window openings as desired. The apparatus of the present invention contemplates having any plurality of window openings from a minimum of two on up. Further, each window opening is envisioned as being of substantially identical size so that cards or the like having the same size will be insertable in any of said window openings. Also, one frame apparatus could have openings sized for cards, and a second frame have openings sized for photographs.

Figure 2:
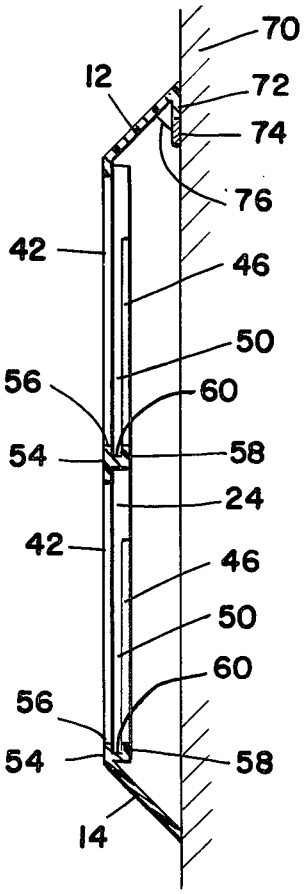
FIG. 2 is a cross-sectional view of the picture frame apparatus of FIG. 1 taken along the line II—II.
Figure 3:
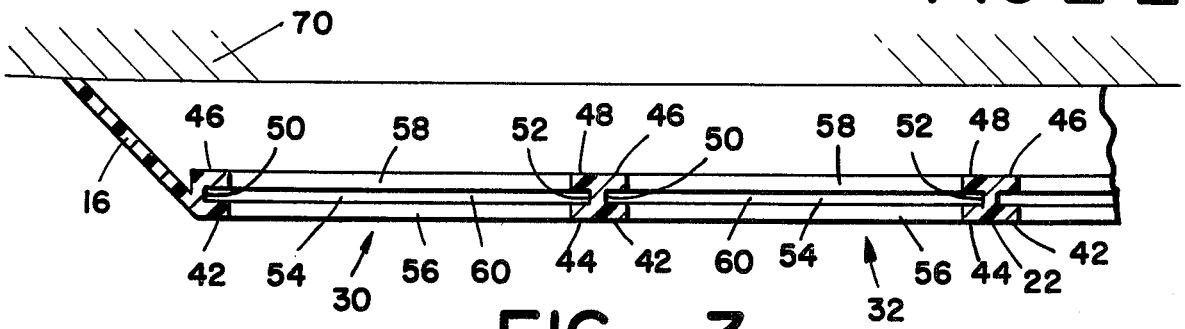
FIG. 3 is an enlarged cross-sectional view of the picture frame apparatus of FIG. 1 taken along the line III—III.

As shown more clearly in the cross-sectional views of FIG. 2 and FIG. 3, associated with each window opening is an elongated slot-defining means formed in said struts whereby a card or the like may be seated therein to thereby position a card or the like in each window opening. Specifically, as shown in FIG. 3, each window opening includes two opposite front flange portions 42, 44. The flange portions 42, 44 are oriented to face one with the other in a common plane, with each positioned one on either side of each said window opening. FIG. 3 illustrates window openings 30 and 32, with the arrows associated therewith indicating the direction of viewing. Note that these said flange portions 42, 44 define the left and right edges of each window opening. The apparatus further includes two opposite rear flange portions 46, 48, similarly arranged to the front flange portions 42, 44, with a respective rear flange 46, 48 being along each side of each window opening and oriented to face one with the other in a common plane. Note that the rear flange portions 46, 48 are positioned in parallel with and behind the opposite front flange portions 42, 44. As can be seen, the resultant structure defines thereby for each window opening a pair of elongated slots 50, 52, with one along either side of the window opening.

Finally, to prevent a card or the like which has been inserted into said elongated slots 50, 52, from exiting through the bottom of the slots 50, 52, i.e. to ensure that the card or the like is properly positioned in said window opening, a base means 54 is provided to act as a stop for the card or the like. As is seen more clearly in FIG. 2, the base means 54 also defines the bottom edge of each said window opening. In the present embodiment, the base means 54 comprises first and second base flange portions 56, 58. These flange portions 56, 58 are oriented in an upward direction and aligned parallel one with the other such that an elongated bottom slot 60 is defined therebetween. To ensure that the card or the like fits properly within both the elongated slots 50, 52, along the side of each window opening, and also within slot 60 at the bottom of each window opening, the first base flange portion 56 is aligned in the same vertical plane as the front flange portion 42, 44 such that said flanges join in common at the bottom front corners of each window opening. Similarly, the second base flange portion 58 is aligned in the same vertical plane as the rear flange portions 46, 48 such that these flanges also join in common at the bottom rear corners of each window opening.

One of the features of the present invention is that cards or the like can be removed and replaced easily and simply from any desired window opening. Further, this feature is designed to be accomplished without sacrificing the sturdiness of the apparatus. In this regard, the rear flanges 46, 48 are sized such that a card or the like can be slipped into the elongated slots 50, 52 without impediment from the flange structures of adjoining window openings. In the preferred embodiment, the rear flanges 46, 48 are constructed such that they extend from the base 54 up to a slightly lesser height than the top of the given window opening, and corresponding flange portions 42, 44. Thus when a card is desired to be inserted into the slot, it is enabled to clear the rear flanges and abut against the top part of the front flanges 42, 44 after which it then can be slipped down the elongated slots 50, 52 until it comes in contact with the base means 54. Obviously, the removal of a given card from a window opening is similarly enabled.

One of the objects of the present invention is to provide a means for hanging a frame portion 10 in such a way that the frame portion and associated struts are easily removable from a wall or other structure when cards are desired to be removed or added, while providing therewith, at all other times, a picture frame apparatus that is securely affixed to said wall. Preliminarily, note that as most easily seen in FIGS. 2 and 3, the frame portion 10 is shaped such that the outer edges of said frame portion 10 are the only parts of the frame portion 10 and associated struts that comes in contact with the wall or other structure, shown in cross-section at 70, to which the frame apparatus is affixed.

In the preferred embodiment, the window openings lie a fixed distance off of said wall or other structure 70 when the frame apparatus is affixed to a wall 70. This is provided to aid in the secure mounting of the picture frame apparatus on the wall 70, and to provide room for said elongated slots. The frame portion 10 extends away from said wall or other structure 70 as the distance along the edge struts to said window openings gets smaller. As is seen in FIGS. 2 and 3, the frame portion 10, i.e. the top and bottom struts 12, 14 and side struts 16, 18, extend away from said wall 70 at a fixed angle when the frame portion is affixed to said wall 70, with only the outer perimeter of each said edge strut abutting the wall 70 surface.

Figure 4:
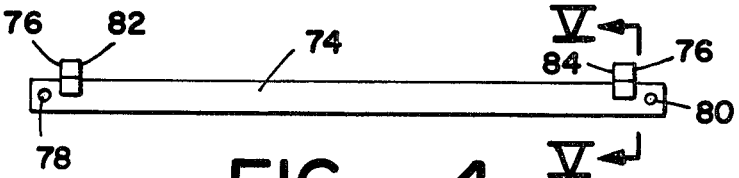
FIG. 4 is a front view of the mounting plate and hooks of the picture frame apparatus of FIG. 1.

As shown in FIG. 2, to provide a simple yet sturdy means for affixing the frame portion 10 to the wall 70, the hanger means of the preferred embodiment includes a top edge flange 72 formed on said top edge strut 12. Secondly, a second unitary piece of molded plastic is provided and formed in the shape of a mounting plate means 74 and attached hook means 76. FIG. 4 illustrates more clearly the said unitary piece of plastic comprising the mounting plate means 74 and attached hook means 76. The mounting plate means 74 is designed to have lesser length than the distance between side struts 16 and 18 of said frame portion 10 to ensure that said frame portion 10 lies flush against said wall 70. Note that means for affixing said mounting plate 74 to said wall 70 is also provided, as shown in FIG. 4, as including mounting plate fastening holes 78 and 80.

Figure 5:
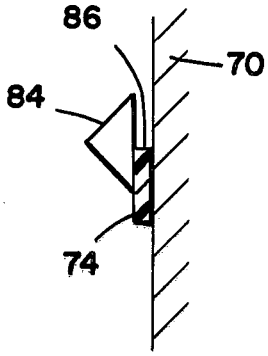
FIG. 5 is a cross-sectional view of the mounting plate and hooks of FIG. 4 taken along the line V—V.
Figure 6:
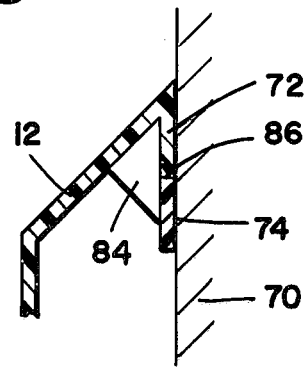
FIG. 6 is an enlarged cross-sectional view of the hanger means of the picture frame apparatus of FIG. 1.

The hook means 76 is defined in a shape such that said top edge flange 72 will mate therewith to thereby removably affix said frame portion 10 and associated strut means to said hook means 76. In the preferred embodiment, the hook means 76 comprises a plurality of hooks 82, 84. As is seen in the cross-sectional view of FIG. 5, these hooks 82, 84 are defined in the shape of a triangle, each of which is attached to the mounting plate means 74. A gap 86 is created behind the hook 84 when the mounting plate means 74 is installed on the wall 70. As shown in FIG. 2 and more clearly in the cross-sectional view of FIG. 6, the top edge flange 72 fits in this gap 86 behind the hooks 82, 84 to provide support for the frame portion 10 thereby. Also, to provide further support, the hooks 82, 84 are defined such that their top corner angle is set to match the angle existing between said top flange 72 and the body of said top edge strut 12.

I claim:

1. A picture frame apparatus for displaying a plurality of baseball cards, photographs, or the like, comprising:

a frame portion including a top edge strut having a top edge flange formed thereon, a bottom edge strut, and first and second side edge struts wherein said edge struts are defined such that said frame portion extends away from a wall or other structure at a fixed angle when said frame portion is affixed thereto, as a function of the distance from the outer perimeter of said frame portion, with the outer perimeter of each edge strut coming in contact with said wall or other structure, said top edge flange formed such that one surface thereof will lie flush against said wall or other structure when the outer perimeter of said edge strut abuts thereto;

hanger means including mounting plate means, means for affixing said mounting plate to said wall or other structure, hook means attached to said mounting plate means, said hook means defined in a shape such that said top edge flange will mate therewith to thereby removably affix said frame portion and associated strut means to said hook means, wherein said hook means comprises a plurality of hooks each said hook including two surfaces which engage to define an angle therebetween which is substantially identical to the angle existing between said top edge flange and the body of said top edge strut such that said top edge flange and strut will mate securely with each hook; and strut means comprising at least one strut interconnecting two of said edge struts such that a plurality of window openings are defined within said frame portion thereby;

said struts including elongated slot defining means positioned adjacent each said window opening such that a card, photograph, or the like may be seated therein to thereby position the card or the like in said opening, said elongated slot defining means comprising:

i. two opposite front flange portions, one positioned on either side of said window opening and oriented to face one with the other in a common plane, said front flange portions defining thereby left and right edges of said window opening;

ii. two opposite rear flange portions, one positioned on either side of said window opening and oriented to face one with the other in a common plane, said rear flange portions being positioned in parallel and behind said opposite front flange portions, such that, between said front and rear flange portions, two elongated slots are defined thereby, one each along each side of said window openings said rear flange portions sized such that said card or the like is enabled to be slid into said elongated slots without impediment; and iii. base means positioned at the bottom of said window opening and defining thereby the bottom edge of said window opening, said base means acting to stop the card or the like from exiting through the bottom of said elongated slots.

2. The apparatus of claim 1 wherein said strut means comprises at least one vertical strut interconnecting said top and bottom edge struts and oriented to be parallel to said first and second side edge struts; and at least one horizontal strut interconnecting said first and second side edge struts and oriented to be parallel to said top and bottom edge struts, wherein each vertical strut joins each horizontal strut at a cross point formed therefrom.

3. The apparatus of claim 2 wherein each said vertical strut and each said horizontal strut are positioned such that all window openings defined thereby are identical in shape.

4. The apparatus of claim 1 wherein said base means comprises first and second base flange portions, oriented in an upward direction and parallel one with the other such that an elongated bottom slot is defined therebetween, said first base flange portion aligned in the same plane as said front flange portions such that said flanges join in common at the bottom corners of said window opening, and said second base flange portion aligned in the same plane as said rear flange portions such that said flanges join in common at the bottom corners of said window opening.

5. The apparatus of claim 1 wherein said two opposite rear flange portions extend from said base means up to generally a slightly lesser height than the top of said window opening.

6. A picture frame for displaying a plurality of baseball cards, photographs, or the like comprising:

a first unitary piece of molded plastic including a frame portion having a top edge strut, a bottom edge strut, first and second side edge struts and at least one strut interconnecting two of said edge struts such that a plurality of window openings are defined within said frame portion thereby, said struts including elongated slot defining means positioned adjacent each said window opening such that a card, photograph or the like may be seated therein to thereby position the card or the like in said opening, said top edge strut further including a top edge flange formed thereon;

a second unitary piece of molded plastic including mounting plate means and attached hook means, said hook means defined in a shape such that said top edge flange is enabled to mate therewith to thereby removably fix said frame portion and associated struts onto said hook means, said hook means comprising a plurality of hooks each said hook including two surfaces which engage to define an angle therebetween which is substantially identical to the angle existing between said top edge flange and the body of said top edge strut such that said top edge flange and strut will mate securely with each hook.

* * * * *